US006722654B1

(12) United States Patent
Johnson et al.

(10) Patent No.: US 6,722,654 B1
(45) Date of Patent: Apr. 20, 2004

(54) GOLF CARD GAME

(76) Inventors: Christopher S. Johnson, 2500 Ashmore, #12, Thousand Oaks, CA (US) 91362; Richard A. Gama, 150 E. Los Angeles Ave., Unit 416, Moorpark, CA (US) 93021; Richard L. Dupree, 1256 Patricia Ave., Apt. 15, Simi Valley, CA (US) 93065

( * ) Notice: Subject to any disclaimer, the term of this patent is extended or adjusted under 35 U.S.C. 154(b) by 0 days.

(21) Appl. No.: 10/339,219

(22) Filed: Jan. 9, 2003

(51) Int. Cl.[7] ..... A63F 3/00
(52) U.S. Cl. ..... 273/245; 273/298; 273/292
(58) Field of Search ..... 273/298, 245, 273/292, 242, 243, 244, 293

(56) References Cited

U.S. PATENT DOCUMENTS 3,944,229 A * 3/1976 Feeney ..... 273/245
3,989,249 A * 11/1976 Breslow ..... 273/108.2
4,126,314 A * 11/1978 Martin ..... 273/245
4,289,315 A * 9/1981 O'Barr ..... 273/298
4,380,338 A * 4/1983 Lacy ..... 273/245
4,546,982 A * 10/1985 Gaines et al. ..... 273/298
D284,878 S * 7/1986 Hollister ..... D21/42
4,598,912 A * 7/1986 Kendrick et al. ..... 273/245
5,000,460 A * 3/1991 Barbiaux et al. ..... 273/245
5,470,077 A * 11/1995 Brewster et al. ..... 273/245
5,497,999 A * 3/1996 Stewart et al. ..... 273/298
5,518,248 A * 5/1996 Lightfoot ..... 273/245
5,692,751 A * 12/1997 Morrissey et al. ..... 273/245
5,720,482 A * 2/1998 Boudrias ..... 273/245
6,386,539 B1 * 5/2002 Deskovick ..... 273/153 J
6,419,229 B1 * 7/2002 Whittington et al. ..... 273/245
6,457,713 B1 * 10/2002 Oppenheimer et al. ..... 273/245
6,568,681 B1 * 5/2003 Meyer ..... 273/298

* cited by examiner

*Primary Examiner*—Benjamin H. Layno
*Assistant Examiner*—Dolores R Collins
(74) *Attorney, Agent, or Firm*—Jack C. Munro

(57) ABSTRACT

A golf card game which utilizes one or more decks of playing cards with each deck being divided into four different suits and there being fourteen different numerical value of cards within each suit. Each deck of playing cards also includes a prescribed number of wild cards. There being separate from the playing cards golf hole representations with each representation to display a golf hole number, a par value for the golf hole number, wild card numbers and a numerical value determining a number of the playing cards that are to be dealt to each player when playing a golf hole number. There is also to be used a plurality of stroke card representations which are numerically sequentially arranged which start with the number 1 and proceed to at least number 5. Cards are to be then dealt to all players and melds to be produced by a player, and when a player has completely melded and the first player to produce all melds will be declared the winner of a given hand and assigned a numerical score. The numerical scores are added for all players for all golf holes which will then determine the winner of the game.

14 Claims, 4 Drawing Sheets

GOLF CARD GAME

BACKGROUND OF THE INVENTION

1. Field of the Invention

The field of this invention relates to card games and more particularly to a card game that is designed to be coordinated with the game of golf.

2. Description of the Related Art

Card games have long been known. It is the intent and purpose of the present invention to produce a card game that connects favorably with the actual playing of a game of golf which is to be interesting and entertaining in play to the players.

SUMMARY OF THE INVENTION

A first basic embodiment of golf card game that comprises a first deck of playing cards composed of a plurality of the playing cards divided into a plurality of different suits with there being a precise number of the playing cards within each suit. A plurality of golf hole representation cards with each representation card to display a golf hole number, a par value for the golf card number, wild card numbers and a numerical value determining a number of the playing cards that are to be dealt to each player when playing of a golf hole number. A plurality of stroke cards which are numerically sequentially arranged in a stack with the stroke cards starting with the number one and proceeding to at least number five. A stroke card is to be displayed to inform the player which stroke is being played at a given time. Whereby the playing cards are to be dealt to all players and the players taking turns to make melds of these playing cards that have the same numerical value or comprise a sequential run of at least three playing cards in the same suit, and the first player to achieve all the melds will be the winner of a played hand. After playing a hand for each golf hole, all the numerical scores are added for all players and the player with the lowest numerical score will be declared the winner of the game.

A further embodiment of the present invention is where the first basic embodiment is modified by there being four in number of suits.

A further embodiment of the present invention is where the first basic embodiment is modified by there being fourteen different numerical cards within each suit.

A further embodiment of the present invention is where the first basic embodiment is modified by there being included a precise number of wild cards within each deck of playing cards.

A further embodiment of the present invention is where the first basic embodiment is modified by there being used two in number of decks.

A further embodiment of the present invention is where the first basic embodiment is modified by there being utilized eighteen in number of the golf hole representation cards.

A further embodiment of the present invention is where the first basic embodiment is modified by there being a wild card that is the same number as the cards dealt for each hand.

A second basic embodiment of the golf card game of the present invention comprises a representation of a first deck of playing cards composed of a plurality of the playing cards divided into a plurality of different suits with there being a precise number of playing cards in each suit. A plurality of golf hole representations are also used with each golf hole representation to display a golf hole number, a par value for the golf hole number, a wild card number and a numerical value determining the number of the playing cards that are to be dealt to each player when playing a particular golf hole number. There is also used a plurality of stroke card representations which are numerically sequentially arranged with each stroke card representation starting with the number one and proceeding to at least number five. A stroke card representation is to be displayed to inform players which stroke is being played at a given time. Whereby the playing cards are to be dealt to all players and the players taking turns to make melds of the playing cards that have the same numerical value or comprises a sequential run of at least three playing cards in the same suit. The first player to achieve all melds will be the winner of a played hand and will obtain a numerical score, and after playing a hand for each golf hole all the numerical scores are added for all the players and the player with the lowest numerical score will be declared the winner of the game.

A further embodiment of the present invention is where the second basic embodiment is modified by there being used four in number of suits.

A further embodiment of the present invention is where the second basic embodiment is modified by there being used fourteen in number of playing cards within each suit.

A further embodiment of the present invention is where the second basic embodiment is modified by there being included a precise number of wild cards within the representation of the first deck of playing cards.

A further embodiment of the present invention is where the second basic embodiment is modified by there being used a representation of a second deck of playing cards with the second deck of playing cards being identical to the first deck of playing cards.

A further embodiment of the present invention is where the second basic embodiment is modified by there being used eighteen in number of golf hole representations. A further embodiment of the present invention is where the second basic embodiment is modified by each golf hole representation listing as a wild card the precise number of cards that are dealt to each player for that representation.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figure 1:
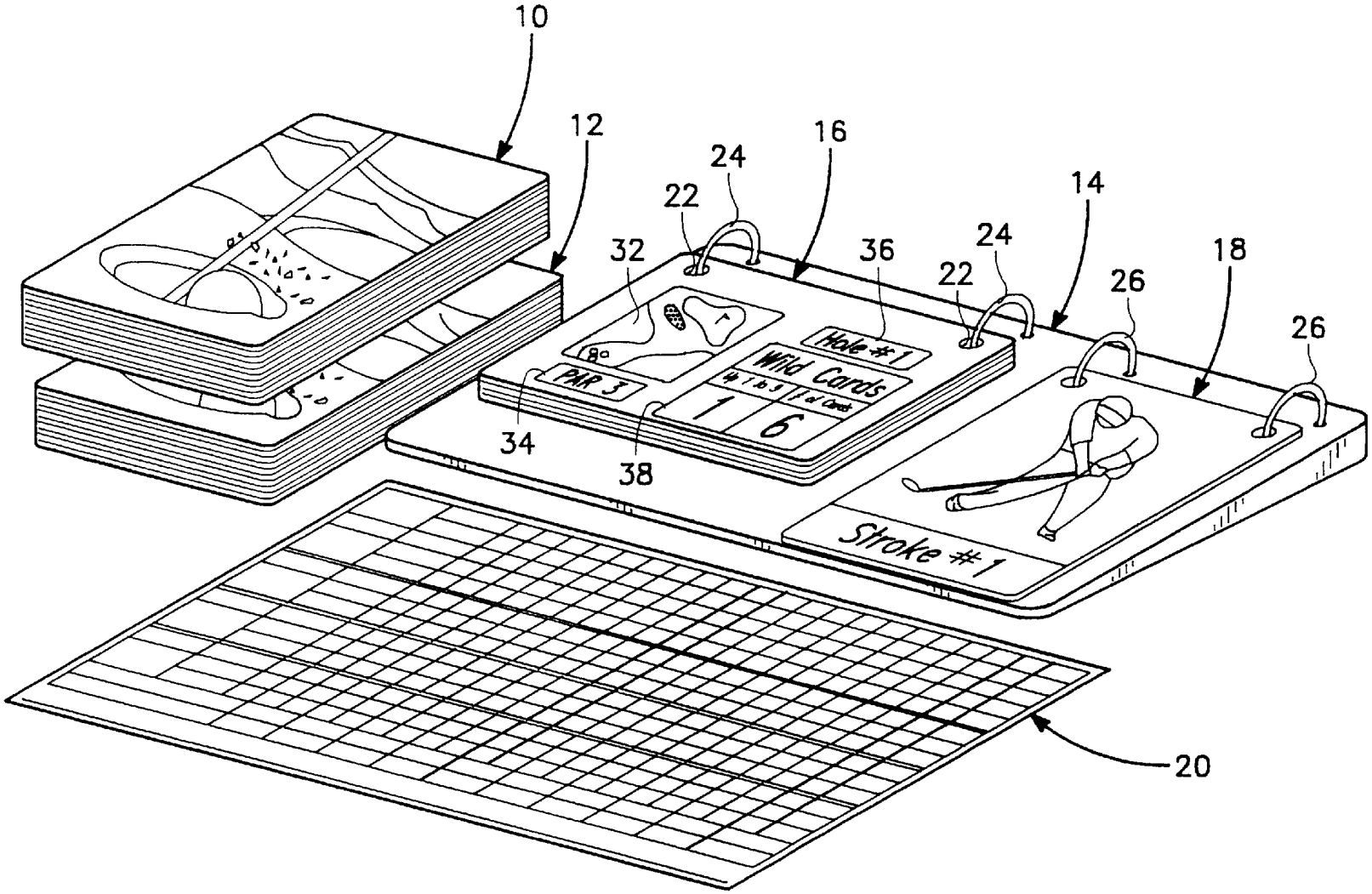
FIG. 1 is an isometric view of the different elements that are used in the golf card game of the present invention.
Figure 2:
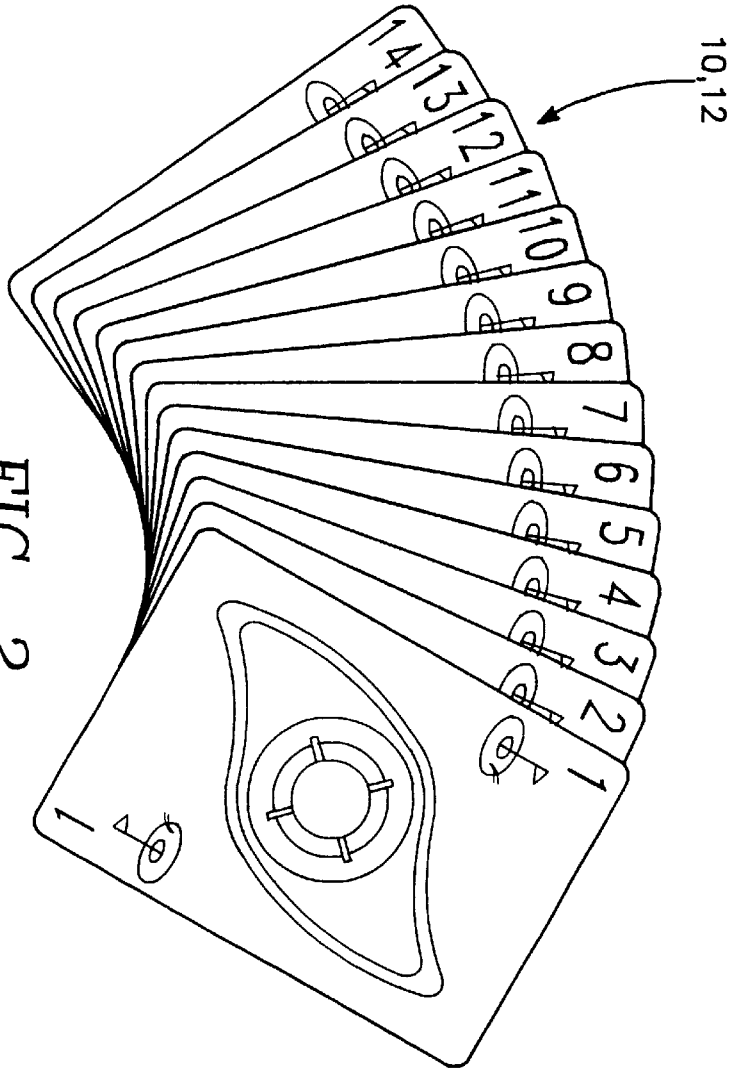
FIG. 2 is a plan view showing the numerical sequential value arrangement for the playing cards within a suit.
Figure 3:
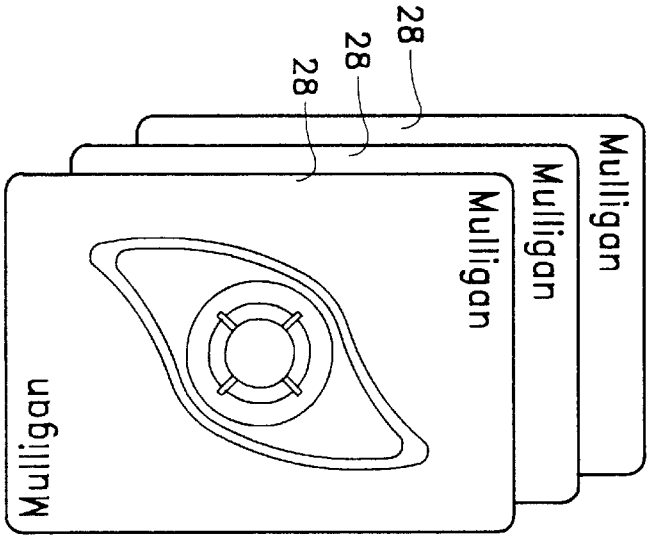
FIG. 3 is a plan view of a series of wild cards that are used within each deck of playing cards of this invention.
Figure 4:
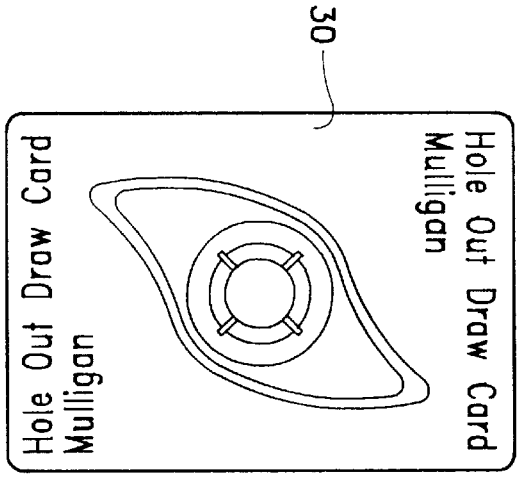
FIG. 4 is a plan view of a single specific wild card that is also used within each deck of playing cards of this invention.

Referring particularly to the drawings, there is shown in FIG. 1 a first deck of cards 10, a second deck of cards 12, a display stand 14, a stack of golf hole representation cards 16, a stack of stroke cards 18 and a score card 20. Each of the golf hole representation cards 16 include a pair of holes 22. Card 16 is located in a stack so that the set of holes 22 on the left side of the cards 16 and a set of holes 22 on the right side of the cards 16 will be aligned. Within each set of aligned holes 22 there is mounted a ring 24 with the ring 24 mounted in conjunction with the display stand 16. This will permit the golf representation card 16 to be flipped as during the playing of the game the players are proceeding from one golf hole to another golf hole. Also mounted by rings 26 to the display stand 16 is a stack of the stroke cards 18. There is to be a stroke card 16 for each number between one and five and these cards are to be located sequentially with the one that is denoted as stroke number one being the first card, then stroke number two the next card, and stroke number three the third card, and so forth. During the time that stroke number one is played during the play of the game, the card 18 that denotes stroke number one will be displayed. When it is time to take the second stroke during the playing of the game, the card 18 that denotes stroke number one will be flipped over exposing the card 18 that denotes stroke number two. During the playing of each golf hole, the appropriate card 18 is to be flipped over to denote the particular stroke value that is being played. It will be one of the player's jobs to make sure that the appropriate stroke card 18 is displayed.

The first deck 10 is to be identical to the second deck 12. Each of the decks 10 and 12 will be divided into four different suits with the suits generally being referred to as "hole in one", "albatross", "eagle" and "birdie". Also included within each deck are four in number of wild cards with three of these wild cards being called a "mulligan" card 28 and one card being called a "hole out" draw card mulligan 30. Each suit within the first deck and second deck includes cards numbering from one to fourteen.

Each of the golf hole representation cards 16 includes a hole layout section 32 which is to give a representation of the particular hole for that particular card and an attractive hole layout will generally include a representation of a golfing green, a sand bunker(s), a fairway and possibly a water hazard. Each of the hole layouts 32 for all the golf hole representation cards 16 will be different. It is to be understood that there will be eighteen in number of the golf hole representation cards 16.

Figure 6:
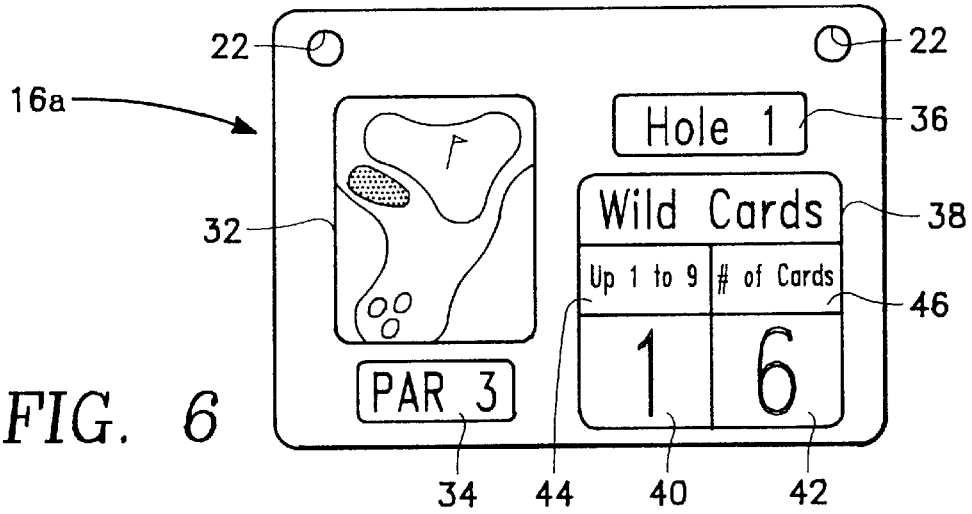
FIG. 6 is a plan view of a golf hole representation for a hole number one.
Figure 7:
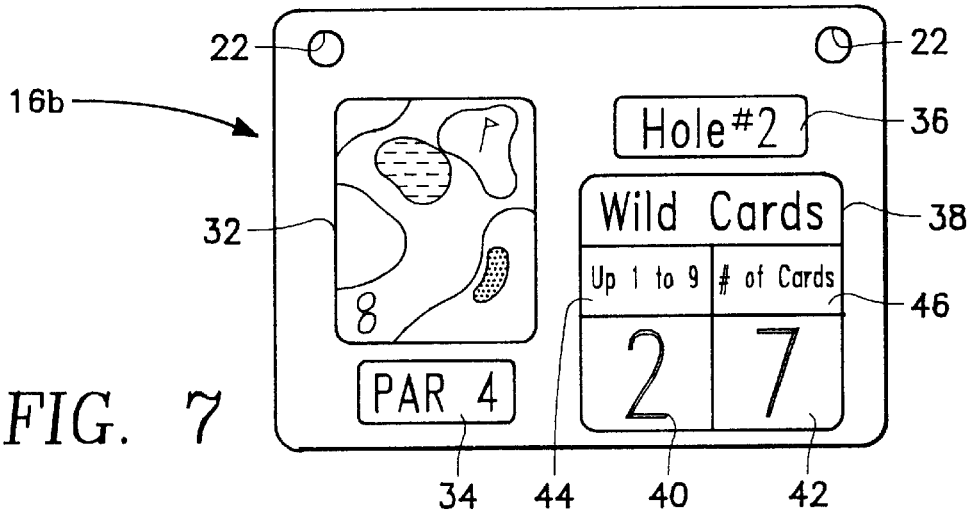
FIG. 7 is a plan view of a golf hole representation for a hole number two.
Figure 8:
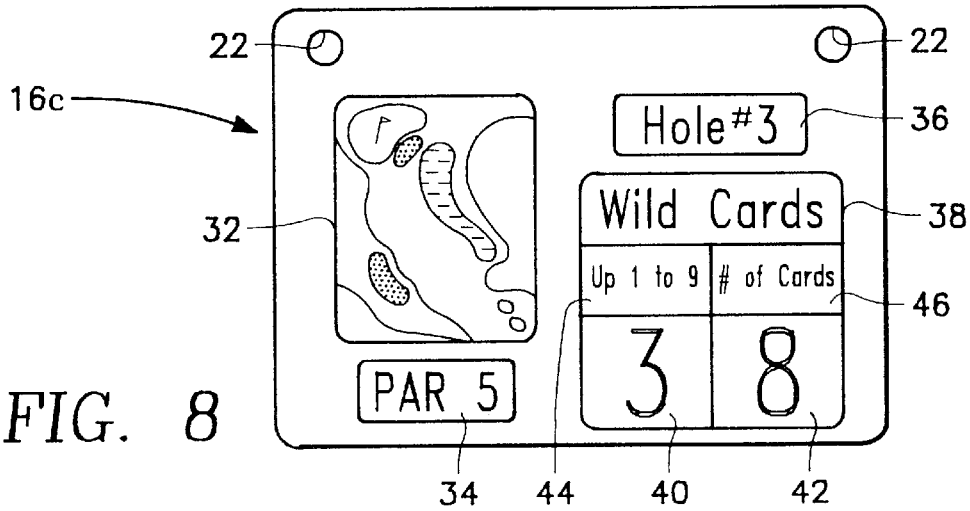
FIG. 8 is a plan view of a golf hole representation for a hole number three.

Each golf hole representation card 16 also includes a designation of the par value for the hole. This designation is included in box 34. In FIG. 6, there is shown a designation value for a par three. In FIG. 7, there is a designation value for a par four and in FIG. 8 there is a designation value for a par five. Generally, there will be included six in number of the par threes, six in number of the par fours and six in number of the par fives within the total number of eighteen golf representation cards 16. This will mean that by adding up the par values of those cards that the par for this golf course will be the number seventy-two, which is a common par value for a golf course. The par values represented in box 34 have actually been selected to be in a sequence with the first golf hole representation card 16*a* being a par three, card 16*b* being par four and card 16*c* being a par five as is shown in FIGS. 6, 7 and 8 and the next series of golf representation cards 16 would also be a par three, par four and a par five, and a third series of a golf representation cards 16 would also be a par three, par four and a par five. That would complete the front nine of the golf holes. For the back nine of the golf holes, the sequence is reversed starting with a par five, then going to a par four, par three and the second series would be a par five, a par four and a par three and the last series would be a par five, a par four and a par three. However, applicant's do not intend to be tied to any specific sequential arrangement concerning the boxes 34 as any desired sequential arrangement could be used.

Each card 16 has a box 36 which is to denote the particular hole for the particular card 16. FIG. 6, card 16*a*, shows in box 36, hole number 1. FIG. 7, card 16*b*, shows hole number 2 for box 36 and FIG. 8, card 16*c*, shows hole number 3 for box 36. There is not shown similar type cards for holes four through eighteen.

There is also a wild card box 38 on each of the golf representation cards 16. The wild card box 38 includes in large letters two numerical letters which are value 40 and value 42. Within FIG. 6, the value 40 is noted as the number 1 which coincides with hole number 1 which is noted in box number 36. The value 40 in FIG. 7 is the number 2 which coincides with the second hole in box 36 and the value 40 is denoted as number 3 in FIG. 8 which coincides with the hole number 3 in box 36. For the front nine of the golf course, which would be the first nine holes represented in box 36, the numbers in box 36 and the value 40 will be the same. This will denote to the user that the particular golf hole representation card, like in FIG. 6, the number 1 will be wild and in FIG. 7 the two will be wild, and in FIG. 8 the three will be wild, and so forth, up until the 9th hole, where the nine will be wild. When you start on the back nine of the course, starting with hole number 10 being represented in box 36, you now start going in a reverse direction and represented for value 40 for the tenth hole would be the number 9. Value 40 will steadily decrease until at hole eighteen the value 40 would be number 1. This particular sequential arrangement is denoted in box 44 which indicates in FIGS. 6, 7 and 8 that you're sequentially in an upward direction that the values 40 will be in sequentially upward to hole 9. Box 44 between the 10th and 18th hole will then start down 9 to 1 indicating that the numbers sequentially would go from 9 to 1 on the back nine of the holes which constitutes holes 10 to 18.

The wild card box 38 also includes a box 46 which indicates the number of cards that are to be dealt. The number of cards to be dealt is represented by the value 42. In other words, for the hole number 1, the number of cards dealt is 6, for hole number 2, the number of cards dealt is 7, and for hole number 3, the number of cards dealt is 8. This continues sequentially so at the 9th hole there will be fourteen cards dealt and starting at the tenth hole there will again be fourteen cards dealt and such will then proceed back to the 18th hole where there will be only six cards dealt which also occurred in hole number 1. The value 42 represents the number of cards that is actually to be dealt at each hole during playing of the game to each player.

Figure 5:
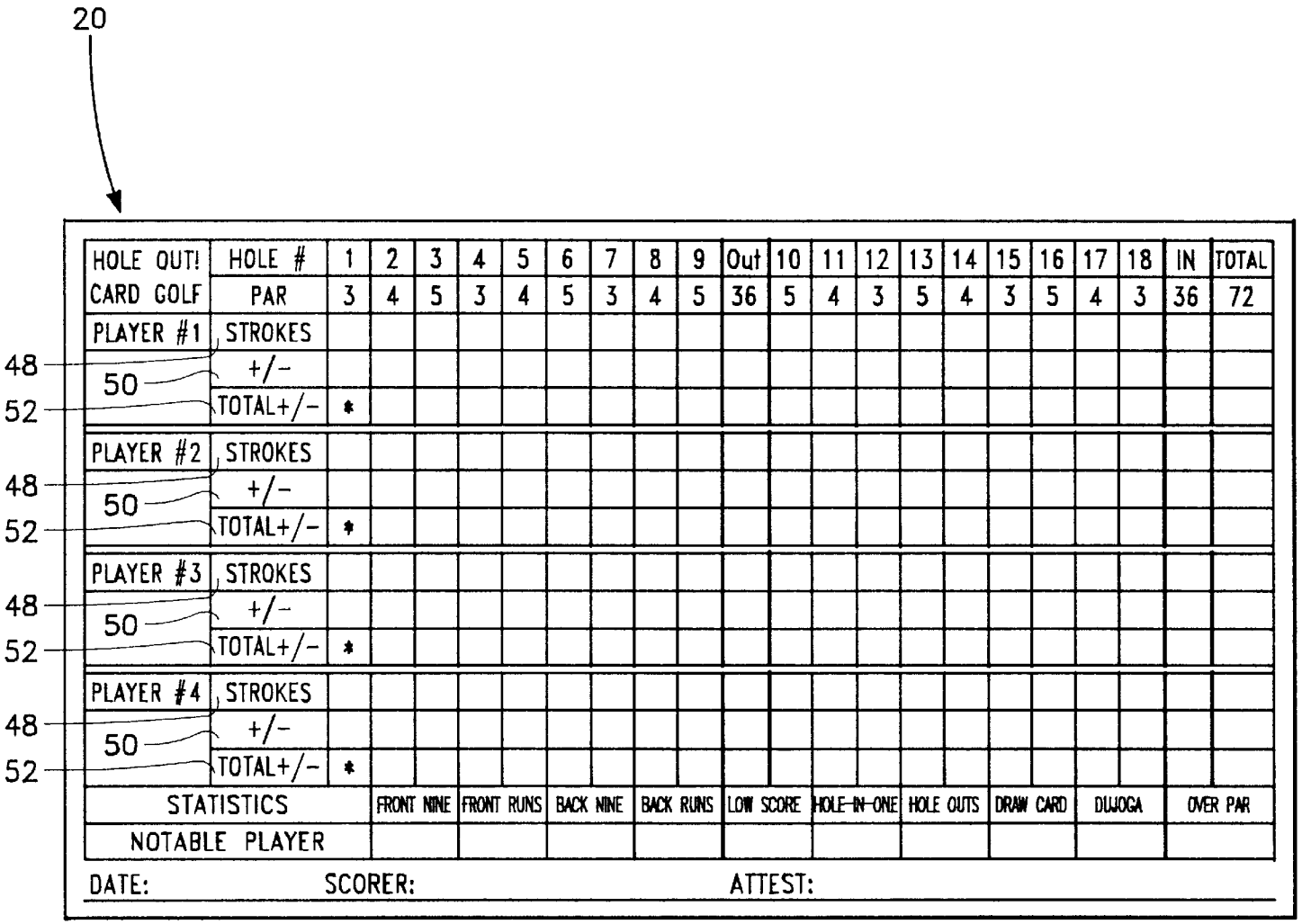
FIG. 5 is a plan view of a score card that is utilized in conjunction with the card game of this invention.

Referring particularly to FIG. 5, the score card 20 resembles a basic score card in the game of golf. There are sections to denote up to four players although in actuality five players can play the game. The number of strokes that each player is to take on each golf hole is to be recorded and finally totaled. At the end of the game, the player with the lowest value will be determined the winner. The recording of the strokes actually played by each player is to be recorded in a strokes line 48 and is to be written in pencil or ink with a writing instrument. Underneath the strokes line 48 is a plus/minus line 50 which will permit the score to add how many strokes a player was over par on a given hole or below par on a given hole. The cumulative of the total over par and under par strokes for each hole can be recorded in the accumulation line 52. The score card has a statistics line which is to be used to record which player had the lowest score for the front nine, the back nine and so forth. There is also included a "dujoga" box which is to record if any player does not have even one meld at the time another player "holes out".

During the playing of the game, it is the intention for each player to match up the cards in his or her hand in order to "hole out" with the least number of strokes on each hole. Each player must match up all the cards in his or her hands into groups of at least three cards. Each group of three or more cards must include the same card of the same number or three or more sequential numbers in a suit (called melds). It is important for each player to be aware of what cards have been selected to be wild cards within box 38 as these wild cards will change for each hole.

The rules of playing the game of this invention is as follows: A player or other person is designated as the scorekeeper and is responsible to record each player's score on the score card 20 at the end of each hole played. Both decks 10 and 12 will be used when there are between three to five players. When there are only two players, only a single deck 10 could be used or actually both decks 10 and 12 could be used. This would be at the option of the players. Each player selects a card from anywhere in the deck and shows it to the others. The player with the lowest card deals first. The wild cards 28 and 30 may be played as either a high or low numbered card which would be selected at the option of the players. After a final shuffle, the playing cards from decks 10 and 12 and the display stand 14 are then given to the dealer.

The dealer for each hole is in charge for the cards 16 and 18 on the display stand 14. The dealer is to announce the hole number, the par value in box 34 and the wild card values 40 and 42 prior to dealing of the cards for that particular hole. The dealer is to set the golf hole representation cards 16 to the appropriate hole number, which at the start of the game would be hole number 1. The stroke cards would also be set to stroke number 1 at the beginning of play. The cards are dealt face down clockwise to the players. After the deal, the remaining cards are placed face down on the playing surface. The top card is turned over and it starts a discard pile to begin play. Play is begun by the first person clockwise of the dealer drawing a card from the stack of cards or taking the top card in the discard pile. Each player proceeds in the same manner and after the stroke is played the dealer will flip card 18 to expose stroke number 2 and the second stroke will be played. If the hole happens to be a par three, there are only a maximum number of three strokes that will be played. If no player has melded out at the end of three strokes, then each player is to determine the number of melds that he or she has and then for each remaining card that is unmelded this will add a stroke to the par value. Whatever stroke value that is determined at the end of each hole will be placed in the appropriate lines 48, 50 and 52 for each player.

At the end of the first hole, the dealer is to turn a card 16 to expose a card 16 for the hole number 2 and play is to proceed in the same manner. After the playing of each hole, the deal and the display stand is to be rotated to the next player. The cards are to be shuffled as needed. All of the cards will be shuffled fresh after play on the front nine holes before starting play on the back nine holes.

A player takes a stroke by selecting a card from the discard pile or drawing a card and then discarding. If a player draws the hole out draw card mulligan card 30, the player must display that card to all the other players and say that he or she has drawn this card and that means that that particular player will be determined to have holed out at the particular stroke value that was being played at that time. In other words, if it happened to be the first stroke, it would be deemed that the player has holed out with a hole in one. If the player drew that card on the third stroke on a hole, it would be the third stroke. Drawing of that card 30 would end play for that particular hole. The hole ends after all players play to the indicated number of par for the particular hole in box 34 or to the number of strokes taken by a player that first achieves melds of all his or her cards. At the end of each hole, all players lay out their cards and the melds are not counted but the unmelded cards would each be assigned a stroke value of plus one in scoring.

When a player achieves all melds, that player is required to call "hole out" to the other players. A discard is laid down and then each of the scoring values for each of the players is determined.

There are numerous different games that can be modified by the playing of the game of the present invention. For example, you can play stroke play where you add up all the strokes for the eighteen holes or you can play match play for each hole. Also, there are other types of games that could be played. Instead of using actual cards, the game could be played on a computer with representations of the cards being displayed.

What is claimed is:

1. A golf card game comprising:

a first deck of playing cards composed of a plurality of said playing cards divided into a plurality of different suits with there being a precise number of said playing cards in each said suit;

a plurality of golf hole representation cards with each of said representation cards to display a golf hole number, a par value for said golf hole number, wild card numbers and a numerical value determining a number of said playing cards that are to be dealt to each player when playing of a said golf hole number;

a plurality of stroke cards which are numerically sequentially arranged in a stack, said stroke cards start with a number 1 and proceed to at least number 5, a said stroke card is to be displayed to inform players which stroke is being played at a given time; and whereby said playing cards are to be dealt to all players with the players taking turns to make melds of said playing cards that have the same numerical value or comprise a sequential run of at least three said playing cards in the same suit and the first player to achieve all said melds will be the winner of a played hand and will obtain a numerical score, and after playing a hand for each said golf hole, all the numerical scores are to be added for all players and the player with the lowest said numerical score will be the winner of the game.

2. The golf card game as defined in claim 1 wherein:

there being four different said suits.

3. The golf card game as defined in claim 1 wherein:

there being fourteen in number of said playing cards in each of said suits.

4. The golf card game as defined in claim 1 wherein:

said playing cards including a plurality of wild cards in said first deck.

5. The golf card game as defined in claim 1 wherein:

there being a second deck of said playing cards which is identical to said first deck.

6. The golf card game as defined in claim 1 wherein:

there being eighteen in number of said golf hole representation cards.

7. The golf card game as defined in claim 1 wherein:

said numerical value that determines the number of said playing cards that are to be dealt to each player also comprises a said wild card that has the same said numerical value.

8. A golf card game comprising:

a representation of a first deck of playing cards composed of a plurality of playing card representations divided into a plurality of different suits with there being a precise number of said playing card representations in each said suit;

a plurality of golf hole representations with each said golf hole representation to display a golf hole number, a par value for said golf hole number, wild card numbers and a numerical value determining a number of said playing cards that are to be dealt to each player when playing a said golf hole number;

a plurality of stroke card representations which are numerically sequentially arranged, said stroke card representations start with the number 1 and proceed to at least number 5, a said stroke card representation to be displayed to inform players which stroke is being played at a given time; and whereby said playing card representations are to be dealt to all players with the players taking turns to make melds of said playing cards that have the same numerical value or comprises a sequential run of at least three said playing cards in the same suit and the first player to achieve all said melds will be the winner of a played hand and will obtain a numerical score, and after playing a hand for each said golf hole, all said numerical scores are added for all players and the player with the said lowest numerical score will be the winner of the game.

9. The golf card game as defined in claim 8 wherein:

there being four in number of said suits.

10. The golf card game as defined in claim 8 wherein:

there being fourteen in number of said playing cards in each of said suits.

11. The golf card game as defined in claim 8 wherein:

said playing cards including a plurality of wild cards in said first deck.

12. The golf card game as defined in claim 8 wherein:

said representation also including a second deck of playing cards with said second deck of playing cards being precisely identical to said first deck of playing cards.

13. The golf card game as defined in claim 8 wherein:

the number of said golf hole representations comprising eighteen.

14. The golf card game as defined in claim 8 wherein:

said numerical value that determines the number of said playing cards that are to be dealt to each player also comprises a said wild card that has the same said numerical value.

* * * * *